US009329562B2

(12) United States Patent
Ishii

(10) Patent No.: US 9,329,562 B2
(45) Date of Patent: May 3, 2016

(54) ELECTRIC APPARATUS AND RESIDUAL ELECTRIC CHARGE DISCHARGING METHOD

(71) Applicant: Tatsuya Ishii, Kanagawa (JP)

(72) Inventor: Tatsuya Ishii, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/601,303

(22) Filed: Jan. 21, 2015

(65) Prior Publication Data

US 2015/0212476 A1 Jul. 30, 2015

(30) Foreign Application Priority Data

Jan. 28, 2014 (JP) ..... 2014-013488

(51) Int. Cl.
*G03G 15/00* (2006.01)

(52) U.S. Cl.
CPC ..... *G03G 15/80* (2013.01); *Y10T 307/944* (2015.04)

(58) Field of Classification Search
USPC ..... 399/88
See application file for complete search history.

(56) References Cited

U.S. PATENT DOCUMENTS 2,442,609 A * 6/1948 Levoy, Jr. ..... B23K 11/26 320/166
3,389,303 A * 6/1968 Tenenbaum ..... H02H 1/06 307/64
3,466,472 A * 9/1969 Vandemore ..... H03K 17/292 327/264
4,771,312 A * 9/1988 Yanase ..... G03G 15/80 307/66
7,664,410 B2 * 2/2010 Takagi ..... G03G 15/2003 399/37
2006/0159482 A1 7/2006 Okada
2007/0212103 A1 * 9/2007 Kikuchi ..... G03G 15/0283 399/88
2012/0045237 A1 2/2012 Aoki et al.
2013/0121717 A1 * 5/2013 Asano ..... G03G 15/205 399/88
2013/0129367 A1 * 5/2013 Jeong ..... H02M 3/33507 399/37
2014/0192574 A1 * 7/2014 Nozaki ..... G03G 15/80 363/77

FOREIGN PATENT DOCUMENTS

| | | |
|---|---|---|
| JP | 2001-117647 | 4/2001 |
| JP | 2006-184329 | 7/2006 |
| JP | 2007-286342 | 11/2007 |
| JP | 2008-009060 | 1/2008 |
| JP | 2012-042835 | 3/2012 |

* cited by examiner

*Primary Examiner* — Rodney Fuller
(74) *Attorney, Agent, or Firm* — Harness, Dickey & Pierce, P.L.C.

(57) ABSTRACT

Example embodiments of the present invention include a power source; a load circuit; a relay provided between the power source and the load circuit; a rectifying circuit connected between an output terminal and an input terminal of the relay; a discharge circuit connected to the power source line on an input side of the relay and to perform, when turned on, discharging operation to discharge an electric charge that remains on each of the input side and an output side of the relay; and a discharge control circuit to turn on the discharge circuit to perform discharging operation when the relay is turned off to stop the power supply input to the load circuit.

17 Claims, 6 Drawing Sheets

ELECTRIC APPARATUS AND RESIDUAL ELECTRIC CHARGE DISCHARGING METHOD

CROSS-REFERENCE TO RELATED APPLICATIONS

This patent application is based on and claims priority pursuant to 35 U.S.C. §119(a) to Japanese Patent Application No. 2014-013488, filed on Jan. 28, 2014, in the Japan Patent Office, the entire disclosure of which is hereby incorporated by reference herein.

BACKGROUND

1. Technical Field

The present invention relates to an electric apparatus, and specifically, to an electric apparatus including a circuit for discharging a residual electric charge and a residual electric charge discharging method to discharge the residual electric charge.

2. Description of the Related Art

In various electric apparatuses, when a power source is disconnected by a relay or a switch that turns off power supply, residual electric charge may be generated in a capacitive element of a load circuit to which power is supplied. This residual electric charge contributes to generation of an inrush current when power is supplied. The inrush current may cause a malfunction of the apparatus by a power source voltage drop, malfunction of a circuit such as reset, and a damage on a circuit element including the relay. Accordingly, it is desired to discharge the residual electric charge generated in the above situation, thus preventing generation of inrush current.

SUMMARY

Example embodiments of the present invention include a power source; a load circuit to receive power supply from the power source; a relay provided between the power source and the load circuit and to be turned on or off to control an input of the power supply from the power source to the load circuit through a power source line according to a state change of the electronic apparatus; a rectifying circuit connected between an output terminal and an input terminal of the relay and to supply a current in a direction opposite to a direction of a flow of current flowing from the power source to the load circuit through the power source line; a discharge circuit connected to the power source line on an input side of the relay and to perform, when turned on, discharging operation to discharge an electric charge that remains on each of the input side and an output side of the relay; and a discharge control circuit to turn on the discharge circuit to perform discharging operation when the relay is turned off to stop the power supply input to the load circuit.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
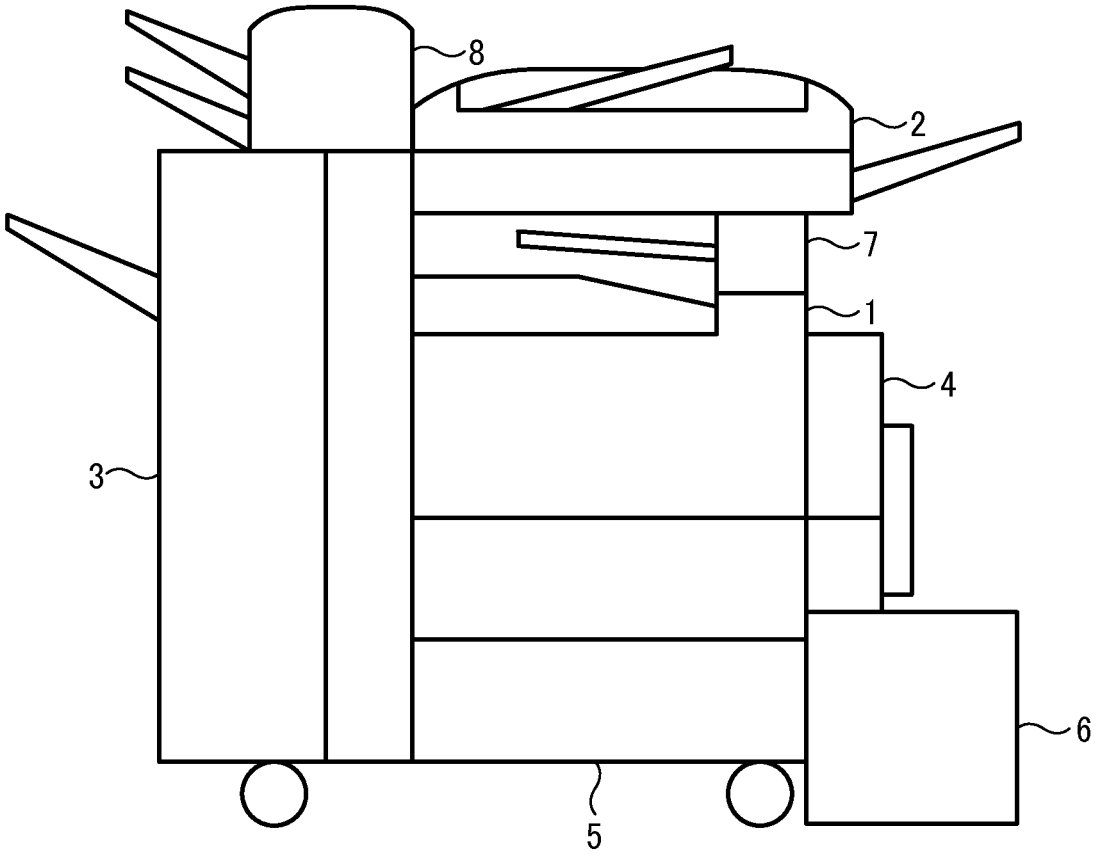
FIG. 1 is a diagram of a structure of an image forming apparatus according to an embodiment of an electric apparatus of the present invention.

The accompanying drawings are intended to depict example embodiments of the present invention and should not be interpreted to limit the scope thereof The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Embodiments of the present invention will be described with reference to the drawings. The embodiments below indicate an example in which an electric apparatus of the present invention is applied to an image forming apparatus. The image forming apparatus includes a printer engine, which processes image data to output processed data, and forms an image based on the processed data on a recording medium such as paper with a recording material such as toner. The printer engine of this example is an electrophotographic printer engine capable of printing at high speeds. The image forming apparatus further includes a plurality of sheet feeding trays, which can load recording sheets of different sizes, such that the image forming apparatus can output a large number of various recording sheets. The image forming apparatus can also perform post-processing. Accordingly, the image forming apparatus requires manual maintenance, such as supplying recording sheets to the plurality of sheet feeding trays and supplying toner.

More specifically, supplying sheets or toner to the image forming apparatus is performed in a state where a door, which is provided in a housing of the image forming apparatus, is opened. Therefore, a user has a risk of contact with a movable part such as a motor, or lesion caused by laser irradiation. In view of this risk that may be caused when the user manually operates in the housing, a power source is disconnected such that power supply to a load circuit is stopped. More specifically, power supply is stopped, in connection with a change in state of the apparatus due to manual operation, such as when opening of the door of the apparatus is detected. Further when closing of the door is detected, power is supplied again. In the present embodiment, the relay that supplies power from the power source to the load circuit is turned off, in response to opening of the door in the housing. Conversely, the relay is turned off to start supplying power from the power source to the load circuit in response to closing of the door.

When the power source is disconnected as the relay is turned off, the residual electric charge is generated in a capacitive element of the load circuit to which power is supplied. When power is supplied again, the residual electric charge may generate the inrush current, which then may cause a malfunction of the apparatus by a power source voltage drop, malfunction of a circuit such as reset, and a damage on a circuit element including the relay. In view of this, the electric charge that remains on each side of a power source circuit and the load circuit is discharged when the relay is turned off, thus preventing generation of the inrush current when the relay is turned on. The image forming apparatus also discharges the electric charge that remains on the load circuit side through the discharge circuit provided on the input side of the relay, using a rectifying circuit (here, a single diode or a plurality of diodes connected in series) connected between an output and input terminals of the relay when the relay is turned off. This prevents generation of the inrush currents caused by the electric charge that remains on each side of the power source circuit and the load circuit.

A detail of the power supply circuit having the above-mentioned discharge circuit will be described below. However, before the description of the power supply circuit, an outline of the image forming apparatus of the present embodiment to which the power supply circuit is applied will be described. FIG. 1 is a diagram of an overall structure of the image forming apparatus according to the present embodiment. The image forming apparatus receives a user input that requests processing of a job such as copying, printing, or facsimile transmission, and performs image forming, for example, by outputting an image formed on a recording sheet. As illustrated in FIG. 1, the image forming apparatus includes an apparatus main body 1, an automatic document feeder 2, a finisher 3 with a stapler and a shift tray, a switch back device 4, an extended sheet tray 5, a large-capacity sheet feeding tray LCT 6, an one-bin sheet ejection tray 7, and an insert feeder 8.

The apparatus main body 1 includes a scanner for reading an original, a printer engine that includes such as an optical writing unit, a photoconductor, and a developing unit to print using a electrophotographic method, a sheet feeding unit, and the like. The apparatus main body 1 includes a main controller that controls the entire apparatus. For example, to process printing in response to the user input that requests printing, the main controller centrally controls each element related to image forming. The main controller further manages an operation state of the apparatus so that each component properly operates. The main controller includes a computer mounted on a controller board provided in the apparatus main body 1. The computer has components such as a central processing unit (CPU), a read only memory (ROM) which operates under control of the CPU, and a dynamic random access memory (DRAM).

The ROM stores a program, data, and the like to be used by the CPU to process image data while controlling operations of the print engine and the sheet feeding unit, etc. Further, the ROM is stored with a program, data, and the like to be used by the CPU to perform data (signal) processing regarding an operation of the power supply circuit to be described below. The DRAM is a memory that temporarily stores data generated by the CPU in operating the program or a memory used as a work memory for the CPU.

Next, the power supply circuit of the image forming apparatus will be described in detail according to the embodiments. As described above, the power supply circuit of the present embodiment includes a circuit that supplies power to the load circuit via the relay and discharges the electric charge remaining on each side of the power source circuit and the load circuit when the relay is turned off. In the following, a drawer unit of the image forming apparatus, which requires power, functions as the load circuit, and the power supply circuit controls on/off of power supplied to the load circuit according to opening/closing of a front door provided in the housing.

(First Embodiment)

Figure 2:
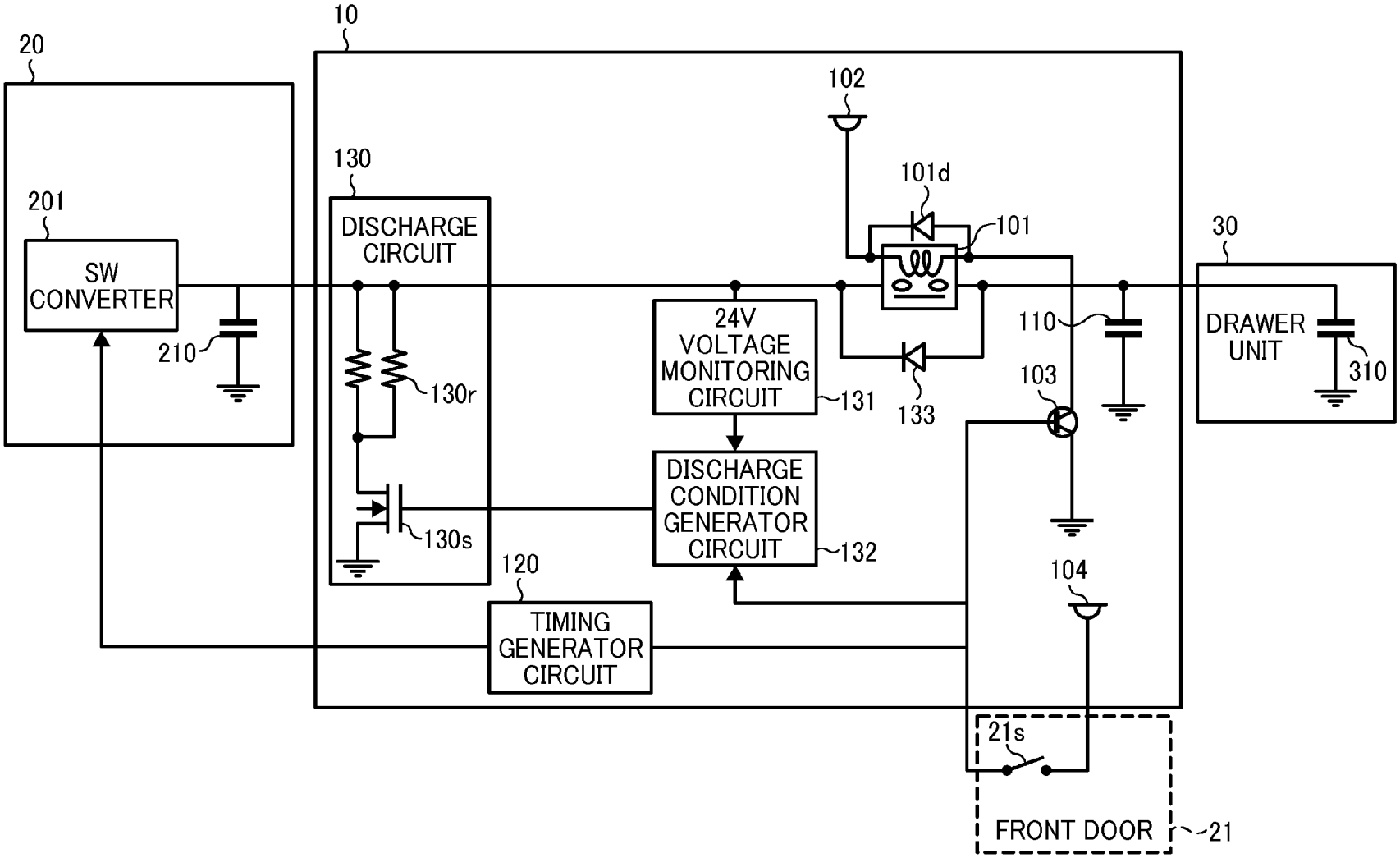
FIG. 2 is a diagram of a structure of a circuit for supplying input power to a load circuit via a relay which controls on/off of the input power in the image forming apparatus of FIG. 1.

A first embodiment illustrates a power supply circuit including a circuit for discharging an electric charge that remains on each side of a power source circuit and a load circuit when a relay is turned off to disconnect a power source. FIG. 2 is a diagram of a structure of a circuit for supplying power to a load via a relay that controls on/off of input power in an image forming apparatus (FIG. 1). With the configuration of FIG. 2, a power source 20 includes a built-in switching regulator and a SW converter 201 for outputting a DC. The power source 20 has a capacitive element 210. In this embodiment, a drawer unit 30 is a load circuit to which power is supplied. The circuit of the drawer unit 30 has a capacitive element 310. A capacitor 110 which is a capacitive element for stabilizing power supply is provided on a substrate 10 of the power supply circuit in parallel to the drawer unit 30 as the load circuit.

The power supply circuit that supplies power of the power source 20 to the drawer unit 30 as the load circuit has various elements mounted on the substrate 10 as illustrated in FIG. 2. One of the elements is a relay 101 that is turned on or off to control input power according to opening/closing of a front door 21. The relay 101 functions as an interlock relay. To turn on/off the relay 101, a junction of the relay 101 is turned on/off by interlocking with opening/closing of the front door 21. The relay 101 may be implemented by an electromagnetic relay having an electromagnetic coil for controlling on/off the junction. Here, the junction of the relay 101 is turned off by supplying a driving current to the electromagnetic coil, and is turned on by not supplying the driving current to the electromagnetic coil. Therefore, a transistor 103 capable of switching controls whether to supply the current from a power source 102 to drive the electromagnetic coil.

When an interlock SW (switch) 21*s* is opened with closing of the front door 21, a voltage from a power source 104 is not applied to the transistor 103, and the switching operation is turned off. In this case, the power is supplied to the drawer unit 30 while the junction of the relay 101 is turned on. On the other hand, when the interlock SW 21*s* is closed with opening the front door 21, the transistor 103 performs on (conduction) operation according to the voltage applied from the power source 104. Accordingly, the driving current flows into the electromagnetic coil of the relay 101, and the junction is turned off. That is, the relay 101 is turned off by interlocking with the opening of the front door 21. A diode 101*d* connected between terminals of the electromagnetic coil of the relay 101 functions as a reflux diode. Also, a diode 133 is connected between an input junction and an output junction of the relay 101. The diode 133 is an element related to a discharge circuit 130 and will be described in detail below.

The power supply circuit further includes a circuit such as the discharge circuit 130 related to operation of discharging the electric charge that remains on each side of the power source 20 and the drawer unit 30 when the relay 101 is turned off to disconnect the power source. The discharge circuit 130 includes a resistance 130*r* connected to a power source line on an input side of the relay 101, and a FET (field-effect transistor) 130*s* having an output end connected to a ground (GND). In this example, the FETs functions as a switching element. With this structure, for example, the electric charge that remains in the capacitive element 210 of the power source 20, which is the input side of the relay 101, at the time of disconnecting the power source is discharged through the resistance 130*r* and the FET 130*s*. In alternative to using the FET 130*s* as the switching element, a switching element such as a bipolar transistor and an insulated gate bipolar transistor (IGBT) may be employed. The switching operation of the FET 130*s* is performed in response to a control input from a discharge control circuit for controlling the discharge circuit 130. That is, the discharge control circuit controls on/off of the discharging operation of the discharge circuit 130 and controls on/off of the FET 130*s* according to a predetermined setting condition. In the present embodiment, a discharge condition generator circuit 132 is directly connected to the FET 130*s*. The discharge condition generator circuit 132 performs the control input to turn on (conduction)/off the FET 130*s*.

Whether to discharge using the discharge circuit 130 is determined according to whether a condition is satisfied. The above condition (referred to as "discharge condition" below) is that an operation state of the relay 101 and the interlock SW 21*s* for the front door 21 become a predetermined state. Therefore, a 24V voltage monitoring circuit 131 is provided as an input-side voltage monitoring circuit for monitoring a voltage generated in the power source line of the input side of the relay 101, to detect the operation state of the relay 101. The 24V voltage monitoring circuit 131 further detects the operation state of the interlock SW 21*s* according to a voltage generated in a control line from the interlock SW 21*s* of the front door 21 to the transistor 103. The discharge condition generator circuit 132 receives an input of the voltage indicating the operation states of the relay 101 and the interlock SW 21*s* of the front door 21 that are detected by the monitoring circuit 131, and determines whether the discharge condition is satisfied. When it is determined that the discharge condition is satisfied, in order to conduct the FET 130*s*, the discharge condition generator circuit 132 switches from an off control output where the discharging operation is not performed, to an on control output where the discharging operation is performed.

The power supply circuit further includes the diode 133 connected between the input junction and the output junction of the relay 101. The diode 133 connects the junctions with defined polarity so that the current flows in a direction opposite to the direction which the current flows through the power source line from the power source 20 to the drawer unit 30 at the time of the power supply. With this structure, for example, the electric charge that remains in the capacitor 110 and the capacitive element 310 of the drawer unit 30 on an output side of the relay 101 at the time of disconnecting the power source is also discharged by the discharge circuit 130 provided on the input side of the relay 101 via the diode 133.

The power supply circuit further includes a timing generator circuit 120, which is provided to perform a series of operations at an appropriate timing without wasting power. The series of operations includes operation of discharging the residual electric charge to prevent the above-mentioned inrush current caused by the electric charge remaining on each of the input and output of the relay 101, and operation of interrupting the SW converter 201 of the power source 20 after disconnecting the power source to the drawer unit 30 by turning off the relay 101. This series of operations is controlled to be performed at an appropriate timing. That is, the operation is performed in an order in which the electric charge remaining on each side of the input and the output of the relay 101 is discharged by the discharge circuit 130 after the SW converter 201 has been interrupted. In order to perform the operation in this order, the timing generator circuit 120 receives the on output of the interlock SW 21*s* of the front door 21 which is also received by the transistor 103 and the discharge condition generator circuit 132. The timing generator circuit 120 generates an operation timing to perform the operations in the above-mentioned order after receiving the on output of the interlock SW 21*s* of the front door 21. The timing generator circuit 120 performs interruption control output at the generated timing relative to the SW converter 201. Also, when the power is supplied to the drawer unit 30 again by closing the front door 21, the operation to restore the power source from the SW converter 201 of the power source 20 is performed after the relay 101 has been turned on. That is, the operation is performed in an order below. The relay 101 is turned on first in a state where the SW converter 201 is interrupted, and then, the power source from the SW converter 201 is restored.

Here, an additional description on the operation for discharging the residual electric charge in the power supply circuit (FIG. 2) will be provided. The power supply circuit controls the disconnection with the power supply and the supply of the power to the drawer unit 30 by turning on/off the relay 101 by interlocking with opening/closing of the front door 21. When the power supply is disconnected, since the relay 101 includes the capacitive elements 210 and 310 (capacitor 110) on each side on the input and the output, the residual electric charge is generated in each capacitive element. In the related art which does not include the discharge circuit of the present embodiment, the inrush current may be generated when the relay is turned on while the residual electric charge remains. The inrush current may reset the operation by the fusion of the fuse inserted on the power source line, welding of the relay contact, and a voltage drop of a supply destination substrate. The reset of the operation occurs because a potential of the GND of a supply-side substrate increases for an amount in which the current is applied to a small resistance of the GND by a flow of a heavy current and this becomes equivalent to the voltage drop for the supply destination substrate. When this voltage drop becomes a monitored voltage of a reset IC, the operation is reset as a result.

In order to prevent the above-mentioned operation caused by the inrush current, the discharge circuit 130 is provided and the residual electric charge is discharged in the present embodiment. Since the residual electric charge is generated on each side of the input and the output of the relay 101, the electric charge is discharged only by the discharge circuit 130 provided on the input side of the relay. The discharge circuit 130 is connected to the diode 133 for supplying the current from the output side of the relay to the input side of the relay so that the current flows to the input side of the relay when the relay 101 is turned off. The reason to connect the diode 133 from the output side of the relay to the input side of the relay is because a voltage of the input side of the relay certainly becomes higher than that of the output side because the power is supplied from the power source 20 of the input side of the relay to the drawer unit 30.

After the relay 101 has been turned off, the SW converter 201 of the power source 20 is interrupted first. Since the residual electric charge remains after the interruption of the SW converter 201, the residual electric charge is discharged by the discharge circuit 130 on the input side of the relay. This is because the discharge circuit 130 is prevented from performing first and the consumption of the wasteful power caused by the discharge can be avoided. Also, this is because a condition to prevent the inrush current to the relay 101 caused by the residual electric charge can be promptly fixed. Also, according to the above-mentioned operation for discharging the residual electric charge, there is a case where a potential of the output side of the relay becomes high. In this case, the electric charge moves towards the input side of the relay. Since the operation is performed in this way, it is preferable to have the discharge circuit 130 on the input side of the relay. The 24V voltage monitoring circuit 131 monitors the voltage of the power source line on the input side of the relay during the discharge. When the monitored voltage decreases to a predetermined voltage, it becomes an operation condition in which the inrush current is not generated. Therefore, the discharging operation is stopped.

After the front door 21 has been closed again and the relay 101 has been turned on, the interruption of the SW converter 201 is canceled, and the power is supplied. The reason to cancel the interruption of the SW converter 201 after the relay 101 has been turned on is because the electric charges are accumulated in the capacitive element 210 on the input side of the relay when the SW converter 201 supplies the power first and this causes the inrush current to the relay 101. The power can be normally supplied under the condition in which the inrush current to the relay 101 generated by the electric charge remaining on each side of the input and the output of the relay 101 can be prevented by discharging the residual electric charge at the above-mentioned timing.

As described above, the electric apparatus of the present embodiment supplies the power to the load circuit via the relay which can be turned on/off. When the relay is turned on, the generation of the inrush current caused by the electric charge remaining on each side of the power source circuit and the load circuit can be prevented.

(Second Embodiment)

Figure 3:
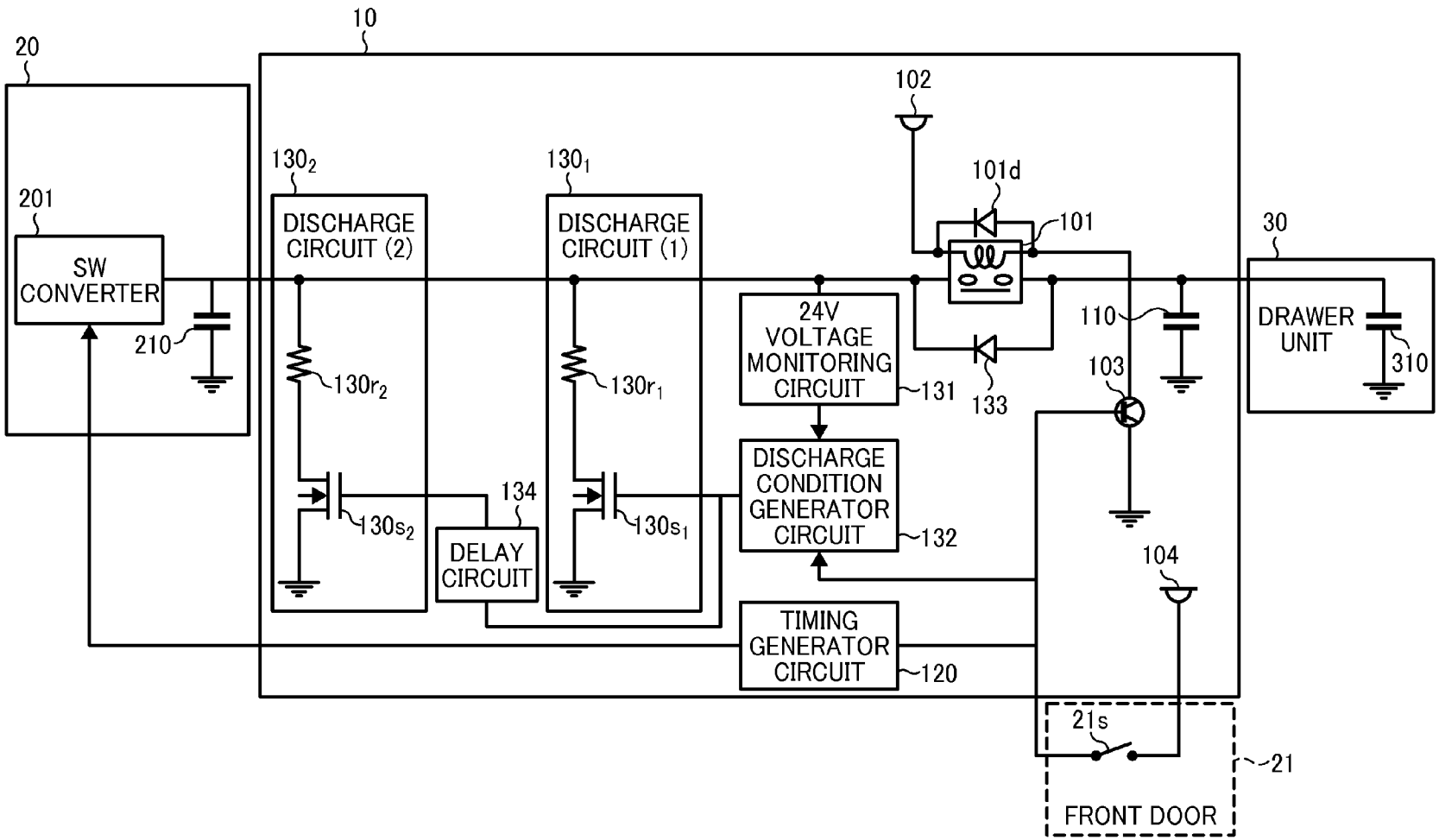
FIG. 3 is a diagram of a power supply circuit of a second embodiment having a discharge circuit of a structure in which a plurality of FETs for controlling on/off of an operation for discharging a residual electric charge is connected in parallel.

The discharge circuit of the power supply circuit according to the first embodiment may be implemented in various other ways, as illustrated in FIG. 3. The discharge circuit 130 in the power supply circuit illustrated in FIG. 2 of the first embodiment has a structure having the resistance 130*r* connected to the power source line on the input side of the relay 101 and the FET 130*s* for performing a switching operation and having the output end connected to the GND. In the structure example of FIG. 2, the discharge circuit 130 includes the single resistance 130*r* and FET 130*s*. Therefore, a voltage generated at the time of the discharge through the resistance 130*r* and the FET 130*s* changes according to an amount of the electric charge that remains when the relay 101 is turned off. However, when the amount of the residual electric charge becomes maximum, a lame voltage is applied to the resistance 130*r* and the FET 130*s*, and the current for flowing at the time of the discharge becomes larger. Therefore, it is necessary to select the resistance 130*r* and the FET 130*s* with a large rating. However, an element with the large rating generally has a large size and a high cost.

FIG. 3 illustrates a discharge circuit having the following structure, which is intended not to easily receive a damage such as element destruction compared with the single element structure in FIG. 2. The discharge circuit of the present embodiment includes a plurality of discharge circuits connected in parallel. The discharge circuit has a structure in which a discharging operation is performed so that a discharge circuit having comparatively large resistance starts to discharge first by shifting respective on control timings of the discharges relative to the plurality of discharge circuits. Similarly to the first embodiment, each discharge circuit has a structure with a resistance connected to a power source line on an input side of a relay and a FET for performing a switching operation and having an output end connected to a GND. The discharge circuit controls the switching operation for turning on the FET when the residual electric charge is discharged and turning off the FET when the discharge ends. Regarding the on control timing of the FET at the time of the discharge, the discharging operation of each discharge circuit is shifted by a method in which an on control signal which is applied to the FET of the discharge circuit for operating at the time of the start is delayed so as to apply the signal to the FET of the next discharge circuit.

FIG. 3 is a diagram of a power supply circuit of the present embodiment having the discharge circuit of a structure in which the plurality of FETs for controlling on/off of an operation for discharging the residual electric charge is connected in parallel. In FIG. 3, the plurality of discharge circuits is connected in parallel so that a discharge circuit (1)$\mathbf{130}_1$ and a discharge circuit (2)$\mathbf{130}_2$ respectively discharge the residual electric charges from the power source line on the input side of the relay to the GND. Here, similarly to the first embodiment, in the structure of each discharge circuits $\mathbf{130}_1$ and $\mathbf{130}_2$, the power source line on the input side of the relay is connected to the resistances $\mathbf{130}r_1$ and $\mathbf{130}r_2$ and the FETs $\mathbf{130}s_1$ and $\mathbf{130}s_2$ for performing the switching operation and having the output end connected to the GND.

Regarding a relationship between the resistances $\mathbf{130}r_1$ and $\mathbf{130}r_2$, a resistance value of the resistance $\mathbf{130}r_1$ is larger than that of the resistance $\mathbf{130}r_2$. Further, since the discharge circuit $\mathbf{130}_1$ having the comparatively large resistance discharges the electric charge first, a control signal output from the discharge condition generator circuit 132 is delayed for a predetermined time by passing through the delay circuit 134. Then, the delayed control signal is output to the discharge circuit $\mathbf{130}_2$. This enables to shift the discharging operations of the discharge circuits $\mathbf{130}_1$ and $\mathbf{130}_2$. Components other than the components according to the above-mentioned discharge circuit in the power supply circuit of the present embodiment (FIG. 3) are the same as those in the power supply circuit of the embodiment (FIG. 2). Therefore, the description of the components common to those of FIG. 2 is omitted here by referring to the description above.

Here, an additional description on the operation of discharging the residual electric charge in the power supply circuit (FIG. 3) will be provided. In this power supply circuit, a resistance value of the resistance $\mathbf{130}r_1$ provided in the discharge circuit $\mathbf{130}_1$ which turns on the FET 130*s*1 and make it perform the discharging operation at the time of the start of the discharge is larger than that of the resistance $\mathbf{130}r_2$ provided in the discharge circuit $\mathbf{130}_2$ which performs the discharging operation next after the predetermined time elapses. Therefore, after the voltage has been lowered a certain amount by the discharge circuit $\mathbf{130}_1$ having the comparatively large resistance value at the time of the start of the discharge, the next discharge circuit $\mathbf{130}_2$ is operated by shifting the time and discharges the residual electric charge so that the residual electric charge becomes a predetermined state.

Figure 4A:
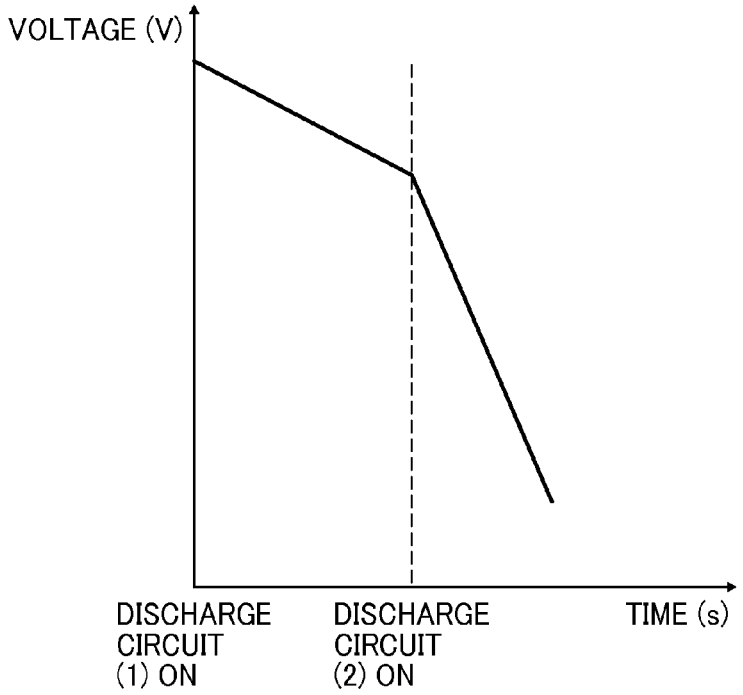
FIGS. 4A and 4B are diagrams illustrating discharging operation states in the circuit in FIG. 3.
Figure 4B:
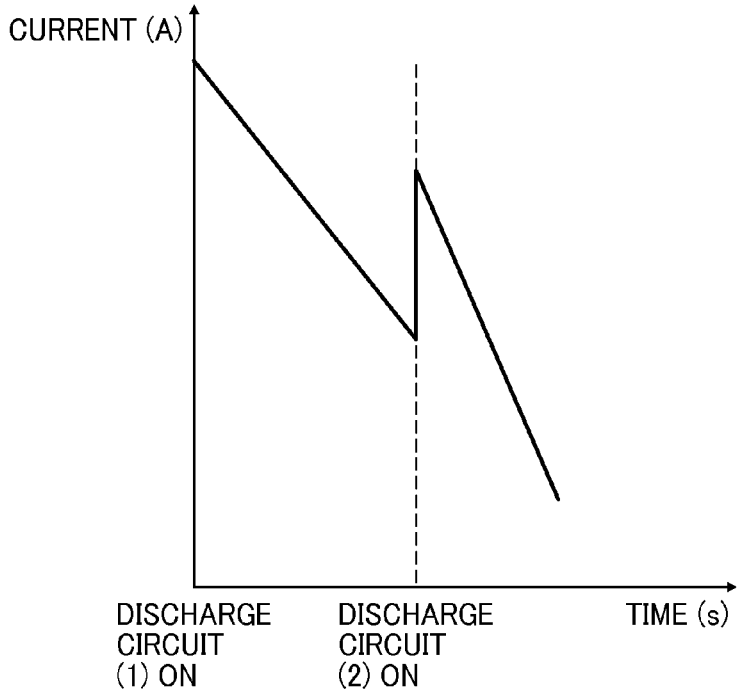

FIGS. 4A and 4B are diagrams illustrating discharging operation states of the power supply circuit of the present embodiment (FIG. 3). In FIG. 4A, a vertical axis indicates a voltage, and a horizontal axis indicates a time. Points illustrated as a discharge circuit (1) ON and a discharge circuit (2) ON on the horizontal axis respectively indicate points of time when the discharge circuit $\mathbf{130}_1$ and the discharge circuit $\mathbf{130}_2$ have started to discharge the electric charges. Also, in FIG. 4B, a vertical axis indicates a current, and a horizontal axis indicates a time. Points illustrated as a discharge circuit (1) ON and a discharge circuit (2) ON on the horizontal axis respectively indicate points of time when the discharge circuit $\mathbf{130}_1$ and the discharge circuit $\mathbf{130}_2$ have started to discharge the electric charges similarly to FIG. 4A. The discharge circuit $\mathbf{130}_1$ including elements (resistance and FET) with the larger ratings independently works at the time of starting the discharge and lowers the voltage to a certain degree as illustrated in FIGS. 4A and 4B. After the voltage has been lowered to a certain degree, the discharge circuit $\mathbf{130}_2$ including the elements (resistance and FET) with smaller ratings than those of the discharge circuit $\mathbf{130}_1$ works, and at the same time, the discharge circuit $\mathbf{130}_1$ and the discharge circuit $\mathbf{130}_2$ perform the discharging operation.

At this time, since the resistance value of the discharge circuit $\mathbf{130}_2$ is smaller than that of the discharge circuit $\mathbf{130}_1$ and the discharge circuit $\mathbf{130}_1$ concurrently works, a curve indicating the voltage drop becomes steeper after the discharge circuit (2) ON as illustrated in FIG. 4A. Also, the change of the current becomes larger at the discharge circuit (2) ON as illustrated in FIG. 4B. However, the current is considerably smaller than that in a case where the discharge circuit $\mathbf{130}_1$ independently works at the time of starting the discharge, and in addition, the current is diverted to the discharge circuit $\mathbf{130}_1$ and the discharge circuit $\mathbf{130}_2$. Therefore, the flowing current can be reduced. According to the present embodiment, for example, a possibility that the heat, the destruction, and the like of the element occurs is lower than that in a case where the discharge circuit $\mathbf{130}_1$ independently works or in a case where the discharge circuit $\mathbf{130}_2$ operates first. Accordingly, the damage of the element can be prevented.

(Third Embodiment)

Figure 5:
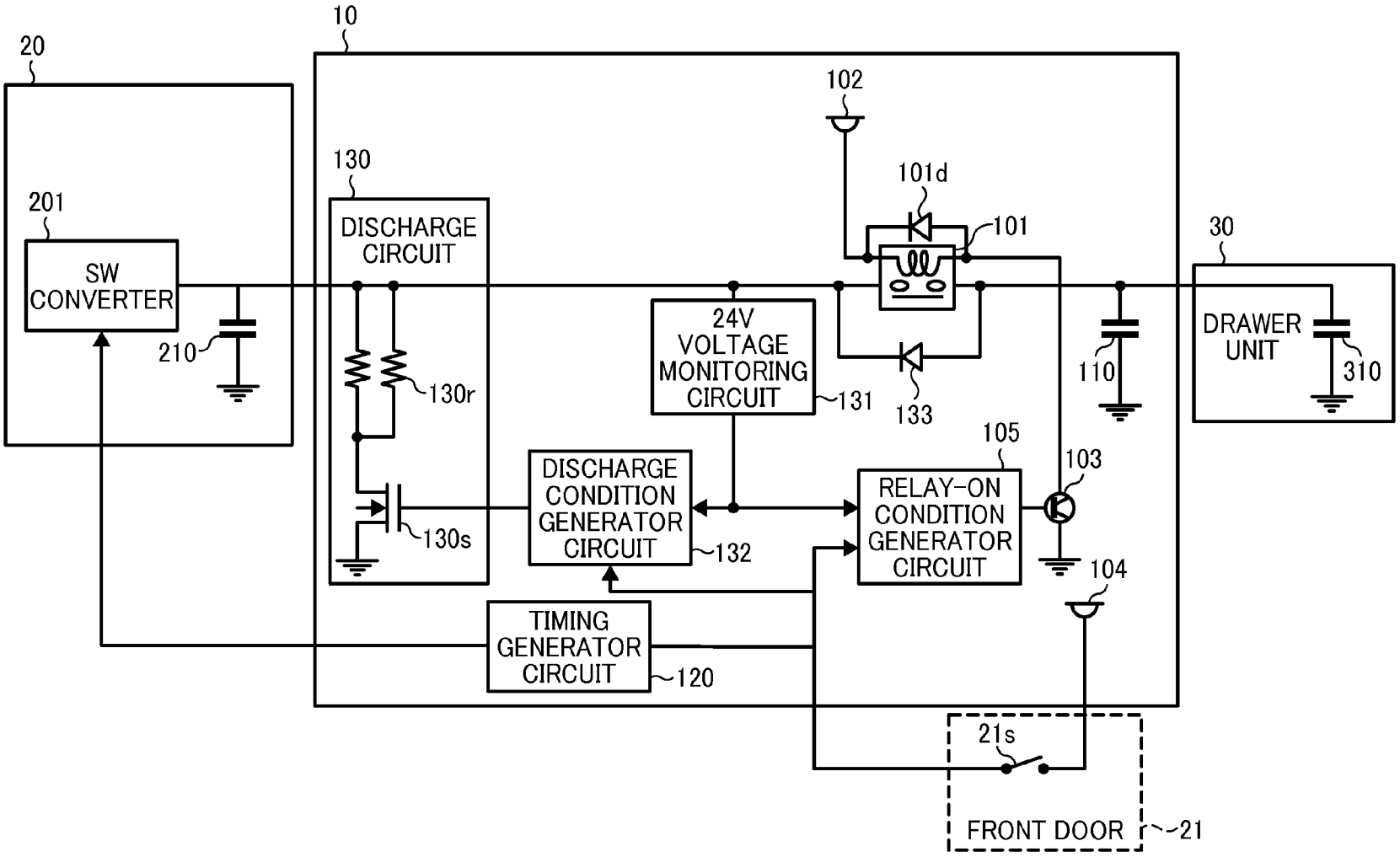
FIG. 5 is a diagram of a power supply circuit of a third embodiment having a circuit element which additionally contorts a condition to avoid an inrush current and turn on a relay.

FIG. 5 illustrates a modified example of the circuit for performing on/off control of the relay in the power supply circuit of the first embodiment. The circuit for performing the on/off control of the relay 101 in the power supply circuit illustrated in FIG. 2 of the first embodiment controls on/off of the relay 101 by interlocking with closing/opening of the front door 21. The interlock SW 21*s* is opened/closed by closing/opening the front door 21, and the switching operation of the transistor 103 is turned on (conduction)/off according to this. Then, the relay 101 is turned on/off by leading the operation as to whether the electromagnetic coil of the relay 101 is driven. That is, the relay 101 is turned on/off by immediately interlocking with the closing/opening of the front door 21 which is manually performed.

In the power supply circuit of FIG. 2, the power from the SW converter 201 of the power source 20 to the substrate 10 of the power supply circuit is interrupted and supplied by interlocking with the opening/closing of the front door 21 which is manually performed. Therefore, operation timings to interrupt and turn on the power source 20 which interlock with the opening/closing of the front door 21 are different every time. For example, a time from the interruption to the supply of the power may become very short. In this case, since the power is supplied again in a state where the discharge of the residual electric charge has not been completed, an inrush current flows.

In view of the case where the time of interruption to the supply of the power of the power source 20 becomes very short, it is desired to prevent the generation of the inrush current. In the present embodiment, an additional element is provided, which performs on control of a relay for turning on/off the power supply to a load circuit under an operation condition in which the inrush current can be avoided. The additional element adds a condition that a voltage value monitored by a voltage monitoring circuit on an input side of the relay is lowered to a value equal to or lower than a predetermined value by a discharging operation of a discharge circuit. The element is configured as a circuit for outputting a signal to turn on the relay. Regarding the power supply circuit in FIG. 2, a circuit for generating a signal to turn on the relay 101 is added having a condition that an input-side voltage of the relay 101 monitored by the 24V voltage monitoring circuit 131 becomes, for example, almost zero V and an output which indicates that the front door 21 is closed is generated.

FIG. 5 is a diagram of the power supply circuit of the third embodiment having a circuit element which adds a condition to avoid the inrush current and turn on the relay 101. In FIG. 5, a relay-on (ON) condition generator circuit 105 is included as the circuit element for adding the condition to avoid the inrush current and perform the on control of the relay 101. On/off of the relay 101 is controlled by turning on (conduction)/off the switching operation of the transistor 103 similarly to the power supply circuit in FIG. 2. Therefore, the relay-on condition generator circuit 105 generates and outputs the signal to make the transistor 103 turn on/off the switching operation.

In the relay-on condition generator circuit 105, whether to turn on (conduction) the transistor 103 is determined according to whether a condition is satisfied. The condition (referred to as "on condition" below) is that the monitored input-side voltage of the relay 101 becomes almost zero V and the front door 21 is closed. Therefore, the 24V voltage monitoring circuit 131 which monitors the voltage generated in the power source line on the input side of the relay 101 receives the output monitored voltage. As described in the first embodiment above, the 24V voltage monitoring circuit 131 is provided to determine a discharge condition of the discharge circuit 130. Also, a closing state of the front door 21 is detected by a signal which appears in a signal line connected to the interlock SW 21*s* of the front door 21. Therefore, when determining that the on condition is satisfied, the relay-on condition generator circuit 105 can perform the expected on control of the relay by outputting the control signal for turning off the switching operation of the transistor 103.

Components other than the components according to the relay-on condition generator circuit 105 which is a circuit element for avoiding the inrush current and adding the condition to turn on the relay 101 in the power supply circuit (FIG. 5) of the present embodiment are the same as those in the power supply circuit (FIG. 2) of the embodiment. Therefore, the description of the components common to those of FIG. 2 is omitted here by referring to the description above.

Here, an additional description regarding the on/off control operation of the relay 101 by the relay-on condition generator circuit 105 is provided. In the power supply circuit, the power supply to the drawer unit 30 is cut off by turning off the relay 101 according to the interlocking operation. In the interlocking operation, when the front door 21 is opened, the transistor 103 is turned on according to a control output from the relay-on condition generator circuit 105, and then, the electromagnetic coil of the relay 101 is driven. The electric charges remaining on each side of the input and the output of the relay 101 are discharged until the electric charges are gone by operating the discharge circuit 130 after the relay 101 has been turned off. However, there is a case where the front door 21 is closed before the completion of the discharge.

In this case, in the power supply circuit (FIG. 2) in FIG. 2, the relay 101 is immediately turned on and the power is supplied according to the interlocking operation such that the transistor 103 is turned off by closing the front door 21 and the drive of the electromagnetic coil of the relay 101 is stopped. In this operation state, since the power is supplied while the residual electric charge remains, the generation of the inrush current cannot be avoided. Whereas, in the power supply circuit (FIG. 5) of the present embodiment, even when the control signal for turning off the transistor 103 by closing the front door 21 is generated, the control signal is not output to the transistor 103 until the monitored input-side voltage of the relay which is the another on condition becomes almost zero V.

That is, the relay-on condition generator circuit 105 outputs the control signal for turning off the transistor 103 which interlocks with the on control of the relay 101 when the another condition is satisfied. The another condition is such that the monitored voltage on the input side of the relay output by the 24V voltage monitoring circuit 131 becomes almost zero V. According to the addition of the relay-on condition generator circuit 105 for outputting the control signal to turn on the relay 101 based on the on condition, there is no residual electric charge when the relay 101 is turned on. Accordingly, the generation of the inrush current caused by turning on the relay 101 can be avoided.

(Fourth Embodiment)

In this embodiment, a determination function is added which determines an abnormality during a discharging operation performed by the discharge circuit 130 which is an element of the power supply circuit of the first embodiment. In the power supply circuit illustrated in FIG. 2 of the first embodiment, the discharge circuit 130 discharges the electric charge remaining in the capacitive element 210 and the like after the power source is turned off. The discharge circuit 130 has a structure in which the power source line on the input side of the relay is connected to the resistance 130*r* and the FET 130*s* for performing the switching operation and having the output end connected to the GND. Also, the diode 133 is connected between the input and output junctions of the relay 101 so that the electric charge can move from the output side to the input side of the relay in a relay-off state. The discharge circuit 130 with the above structure discharges the electric charge remaining in the capacitive element connected to the power source lines on each side of the input and the output of the relay 101.

In the power supply circuit in FIG. 2, since the residual electric charges are accumulated in the capacitive elements 210 and 310 and the capacitor 110, the rating of the FET and the like to be employed is selected by the discharge circuit 130 by assuming the maximum residual electric charges accumulated in these capacitive elements. When an element of the FET and the like having a large rating is selected, the possibility that the damage occurs is reduced. However, a size of a part becomes larger, and this causes a design problem and a high cost. Therefore, an appropriate rating is selected in terms of these conditions. Therefore, the element of the FET and the like is in danger of being damaged according to the circumstances.

In view of the above, an element for determining the abnormality of the discharge circuit 130 which causes the damage of the element of the FET and the like is added to a basic circuit of the power supply circuit in FIG. 2. In the present embodiment, the abnormality determination of the discharge circuit 130 is operated by a CPU of a control unit of the power supply circuit according to a control program. The control unit may be implemented by a main controller of the image forming apparatus. As described above, the main controller has a function to control an entire apparatus and generally manages each element regarding an image output processing system and controls the operation of the elements. At the same time, the main controller performs maintenance of the same.

In the abnormality determination of the discharge circuit 130 of the present embodiment, it is determined whether an abnormality of a circuit occurs which corresponds to an open failure and a short failure of the FET 130*s* which is the element of the discharge circuit 130. When it is determined that there is the abnormality as a result of the abnormality determination of the discharge circuit 130, the CPU issues a warning indicating the generation of the failure to exchange the FET 130*s* through a display of an operation panel of the image forming apparatus and the like before the relay 101 is damaged.

The determination regarding the open failure of the FET 130*s* is made according to whether there is a potential caused by the electric charge remaining on the input side of the relay when a certain period of time elapses after the relay 101 has been turned off Therefore, a voltage generated in the power source line on the input side is obtained by setting a time when it is assumed that the residual electric charge be lost in a case where the discharge circuit 130 normally works. Then, it is determined whether the obtained voltage is equal to or lower than a predetermined value which is close to zero V. When the obtained voltage does not become equal to or lower than the predetermined value, it is assumed that the open failure of the FET 130*s* occur. A monitored voltage of the 24V voltage monitoring circuit 131 is used as the voltage generated in the power source line on the input side. The 24V voltage monitoring circuit 131 is provided as an element for the power supply circuit (FIG. 2) in the first embodiment to perform the discharging operation.

Also, the determination regarding the short failure of the FET 130*s* is made according to whether there is a potential caused by the power supply to the output side of the relay when a certain period of time elapses after the relay 101 has been turned on. Therefore, a voltage generated in the power source line on the output side of the relay is obtained by setting a time when it is assumed that the power be supplied to the load circuit when the discharge circuit 130 normally works. Then, it is determined whether the obtained voltage is equal to or lower than the predetermined value which is close to zero V. When the obtained voltage becomes equal to or lower than the predetermined value, it is assumed that the short failure of the FET 130*s* occur. Since the voltage generated in the power source line on the output side is not detected in the power supply circuit (FIG. 2) of the first embodiment, it may be necessary to newly add such element to detect the voltage as illustrated in FIG. 6.

Figure 6:
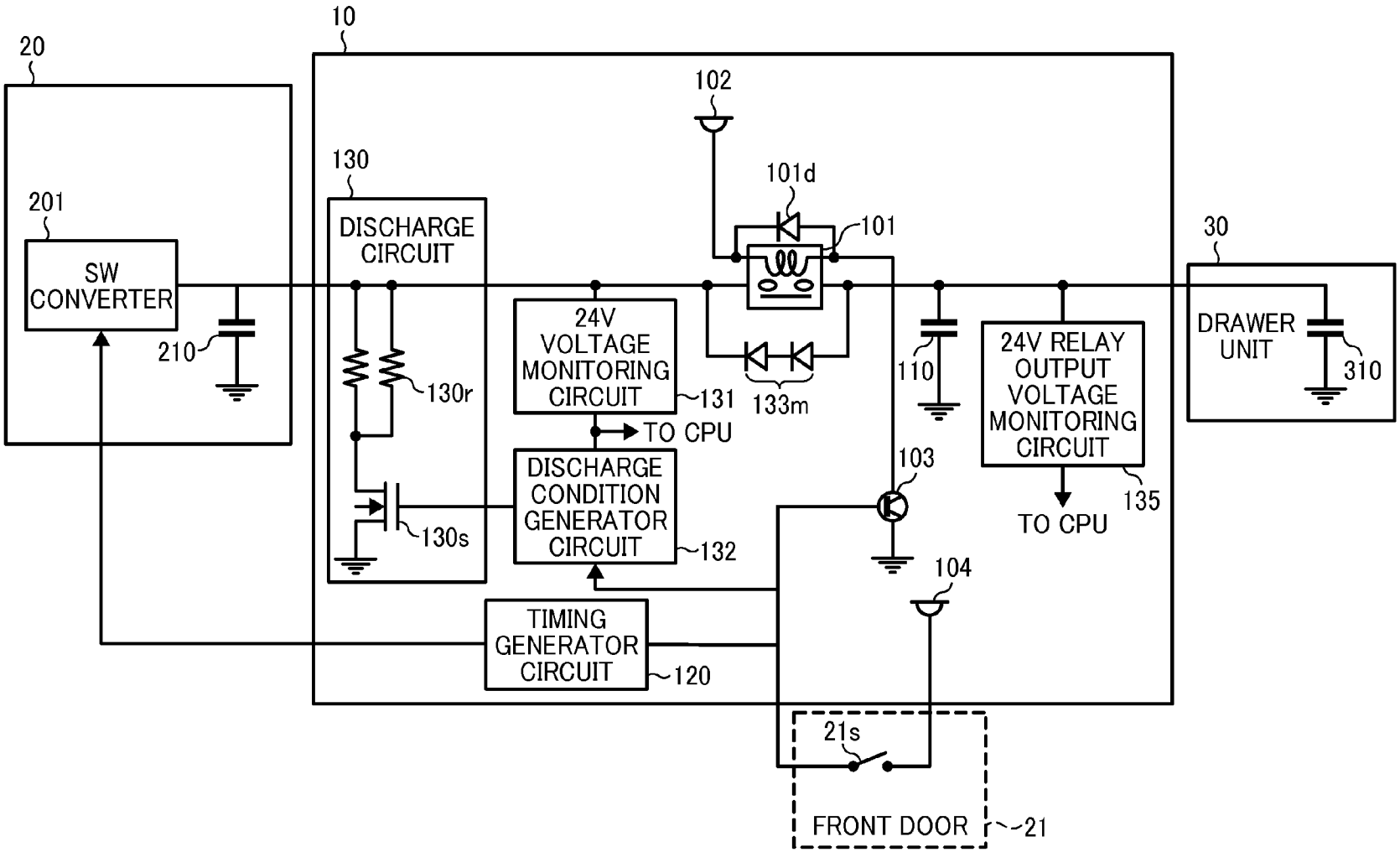
FIG. 6 is a diagram of a power supply circuit including a discharge diode of a structure in which a plurality of diodes are connected in series (fourth embodiment) and a function for determining an abnormality of the discharging operation (fifth embodiment).

FIG. 6 is a diagram of the power supply circuit of the present embodiment having the function for determining the abnormality in the discharging operation. In FIG. 6, the power supply circuit includes a 24V relay output voltage monitoring circuit 135 for monitoring the voltage generated in the power source line on the output side of the relay as an element to realize the function for determining the abnormality of the discharging operation. The monitored voltage of the 24V relay output voltage monitoring circuit 135 is input to the CPU of the main controller. Also, since the monitored voltage of the 24V voltage monitoring circuit 131 in the previous embodiment is used to realize the abnormality determination function, the monitored voltage of the 24V voltage monitoring circuit 131 is also input to the CPU of the main controller. A diode 133*m* connected between the input and output junctions of the relay 101 in FIG. 6 is different from the diode 133 indicated in the first embodiment in FIG. 2. This is because the fourth embodiment and the fifth embodiment use FIG. 6 in common. The difference between the structures of the diodes does not directly relate to the present embodiment, such that the diode 133 in FIG. 2 may be used.

Components other than the components according to the 24V relay output voltage monitoring circuit 135 and the 24V voltage monitoring circuit 131 to realize the function for determining the abnormality of the discharging operation in the power supply circuit (FIG. 6) of the present embodiment is the same as those in the power supply circuit (FIG. 2) of the first embodiment. Therefore, the description of the components common to those of FIG. 2 is omitted here by referring to the description above.

Here, an additional description regarding an operation by the function for determining the abnormality of the discharging operation is provided. In the power supply circuit, the relay 101 is turned off and the power supply to the drawer unit 30 is cut off by interlocking with the opening of the front door 21. The electric charge remaining on each side of the input and output of the relay 101 are discharged until they are gone by operating the discharge circuit 130 after the relay 101 has been turned off. At this time, the CPU of the main controller manages the operation of the discharge circuit 130 by determining whether the open failure of the FET 130*s* occurs which prevents a normal discharging operation of the discharge circuit 130. In a procedure to determine the open failure of the FET 130*s*, the monitored voltage of the 24V voltage monitoring circuit 131 is obtained when a certain period of time elapses after the relay 101 has been turned off, and it is determined whether the obtained voltage becomes equal to or lower than the predetermined value which is close to zero V. The certain period of time after the relay 101 has been turned off is a time required until the discharge of the residual electric charge has been completed and can be found by an experiment and the like. When the monitored voltage does not become equal to or lower than the predetermined value which is close to zero V, it is assumed that the open failure of the FET 130*s* occur.

Also, the relay 101 is turned on and the power is supplied to the drawer unit 30 again by interlocking with the closing of the front door 21. When the power is supplied to the output side of the relay after the relay 101 has been turned on, the electric charges are accumulated in the capacitive element 210 and the like. At this time, the CPU of the main controller manages the operation of the discharge circuit 130 by determining whether the short failure of the FET 130*s* occurs which prevents a normal discharging operation of the discharge circuit 130. In a procedure to determine the short failure of the FET 130*s*, the monitored voltage of the 24V relay output voltage monitoring circuit 135 is obtained when a certain period of time elapses after the relay 101 has been turned on, and it is determined whether the obtained voltage is equal to or lower than the predetermined value which is close to zero V. The certain period of time after the relay 101 has been turned on is a time required until the power is supplied to the load circuit again and can be found by the experiment and the like. When the monitored voltage becomes equal to or lower than the predetermined value which is close to zero V, it is assumed that the short failure of the FET 130*s* occur.

(Fifth Embodiment)

FIG. 6 is a modified example of the structure of the diode connected between the input and the output junctions of the relay 101 which is an element of the power supply circuit of the first embodiment. In the power supply circuit illustrated in FIG. 2 of the first embodiment, the discharge circuit 130, which discharges the electric charges remaining in the capacitive elements 210 and 310 and the like after the power source is turned off, is connected between the power source line on the input side of the relay and the GND. Therefore, the discharge circuit 130 provided on the input side also discharges the electric charge remaining on the output side of the relay 101. Therefore, the diode 133 (referred to as "discharge diode" below) is connected between the input and output junctions of the relay 101. The discharge diode allows the electric charge to move from the output side of the relay to the input side in the relay-off state and allows the discharge circuit 130 to discharge the electric charge remaining on each of the input and output side of the relay 101.

In the power supply circuit in FIG. 2, the residual electric charges are accumulated in the capacitive element 310 and the capacitor 110. Therefore, the rating of the diode 133 to be employed as the discharge diode is selected by the diode 133 by assuming the maximum residual electric charges accumulated in these capacitive elements. The diode 133 in the power supply circuit in FIG. 2 includes a single element. When the inrush current is once generated by the residual electric charge which causes the short failure in a case where the diode 133 includes the single element, the diode 133 does not function after that. That is, even when the relay-off operation is performed, the power is supplied to the drawer unit 30. Accordingly, a safety function which disconnects the power source to the load circuit by interlocking with the relay-off operation does not work.

In the present embodiment, the discharge diode has a structure in which a plurality of diodes is connected in series. With the above structure of the discharge diode, when one diode is broken, the safety function which disconnects the power source to the load circuit by interlocking with the relay-off operation can continue to work.

FIG. 6 is a diagram of the power supply circuit of the present embodiment including the discharge diode having the structure in which the plurality of diodes is connected in series. In FIG. 6, the diode 133*m* having a structure in which the plurality of diodes is connected in series is connected between the input and output junctions of the relay 101 as the discharge diode. The diode 133*m* defines a polarity so that a current flows in an opposite direction to that of a current which flows in the power source line from the power source 20 to the drawer unit 30 at the time when the power is supplied. Then, the diode 133*m* connects elements so that the electric charge moves from the output side of the relay to the input side in the relay-off state.

Therefore, the electric charge remaining in the capacitive element 310 and the capacitor 110 on the output side of the relay 101 can be moved to the input side of the relay through the diode 133*m*, and the discharge circuit 130 can discharge the electric charge. Components other than the components of the diode 133*m* as the discharge diode in the power supply circuit (FIG. 6) of the present embodiment are the same as those in the power supply circuit (FIG. 2) of the first embodiment. Therefore, the description of the components common to those of FIG. 2 is omitted here by referring to the description above.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

What is claimed is:

1. An electric apparatus comprising:

a power source;

a load circuit configured to receive power supply from the power source;

a relay provided between the power source and the load circuit and configured to be turned on or off to control an input of the power supply from the power source to the load circuit through a power source line according to a state change of the electronic apparatus;

a rectifying circuit connected between an output terminal and an input terminal of the relay and configured to supply a current in a direction opposite to a direction of a flow of current flowing from the power source to the load circuit through the power source line;

a discharge circuit connected to the power source line on an input side of the relay and configured to perform, when turned on, discharging operation to discharge an electric charge that remains on each of the input side and an output side of the relay; and a discharge control circuit configured to turn on the discharge circuit to perform discharging operation when the relay is turned off to stop the power supply input to the load circuit.

2. The electric apparatus according to claim 1, wherein the discharge circuit includes a plurality of discharge circuits connected in parallel, and the discharge control circuit shifts on control timings of discharge relative to the plurality of discharge circuits.

3. The electric apparatus according to claim 1, wherein the discharge circuit includes a switching element coupled to the power source line and configured to perform the discharging operation when the switching element is turned on, and the discharge control circuit turns on or off the switching element according to a predetermined setting condition.

4. The electric apparatus according to claim 1, wherein the discharge control circuit includes an input-side voltage monitoring circuit configured to monitor a voltage generated in the power source line on the input side of the relay, and the discharge control circuit turns on or off the discharge circuit based on a voltage value monitored by the input-side voltage monitoring circuit when the relay is turned off.

5. The electric apparatus according to claim 4, wherein the discharge control circuit turns off the discharge circuit in response to detection that the voltage value monitored by the input-side voltage monitoring circuit falls to a value equal to or lower than a predetermined value.

6. The electric apparatus according to claim 4, further comprising:

a relay-on condition generator circuit configured to turn on the relay in response to detection that the voltage value monitored by the input-side voltage monitoring circuit falls to a value equal to or lower than a predetermined value through the discharging operation of the discharge circuit.

7. The electric apparatus according to claim 4, further comprising:

an output-side voltage monitoring circuit configured to monitor a voltage generated in the power source line on the output side of the relay; and a controller configured to determine an abnormality of the discharging operation of the discharge circuit based on voltage values respectively monitored by the input-side voltage monitoring circuit and the output-side voltage monitoring circuit when a predetermined time elapses after the relay is turned off or on.

8. The electric apparatus according to claim 1, wherein the rectifying circuit includes a single diode or a plurality of diodes connected in series.

9. The electric apparatus according to claim 1, wherein the state change of the apparatus indicates opening of a door provided in a housing of the electronic apparatus.

10. The electric apparatus according to claim 1, wherein the electric apparatus is an image forming apparatus that forms an image on a recording sheet using a recording material.

11. A method of discharging residual electric charge, performed by an electric apparatus including: a power source; a load circuit configured to receive power supply from the power source; a relay configured to be turned on or off to control an input of the power supply from the power source to the load circuit through a power source line according to a state change of the electronic apparatus, the method comprising:

using a rectifying circuit connected between an output terminal and an input terminal of the relay, supplying a current in a direction opposite to a direction of a flow of current flowing from the power source to the load circuit through the power source line;

using a discharge circuit connected to the power source line on an input side of the relay, performing, when turned on, discharging operation to discharge an electric charge that remains on each of the input side and an output side of the relay; and using a discharge control circuit, controlling discharging operation performed by the discharge circuit so as to turn on the discharge circuit to perform discharging operation when the relay is turned off to stop the power supply input to the load circuit.

12. The method of claim 11, wherein the controlling discharging operation includes:

shifting on control timings of discharge relative to a plurality of discharge circuits, when the discharge circuit includes the plurality of discharge circuits connected in parallel.

13. The method of claim 11, wherein the controlling discharging operation includes:

controlling turning on or off of a switching element coupled to the power source line according to a predetermined setting condition.

14. The method of claim 11, wherein the controlling discharging operation includes:

monitoring a voltage generated in the power source line on the input side of the relay; and turning on or off the discharge circuit based on the monitored voltage value when the relay is turned off.

15. The method of claim 14, wherein the controlling discharging operation includes:

turning off the discharge circuit in response to detection that the monitored voltage value falls to a value equal to or lower than a predetermined value.

16. The method of claim 14, further comprising:

turning on the relay in response to detection that the monitored voltage value falls to a value equal to or lower than a predetermined value through the discharging operation of the discharge circuit.

17. The method of claim 14, further comprising:

monitoring a voltage generated in the power source line on the output side of the relay; and determining an abnormality of the discharging operation of the discharge circuit based on voltage values respectively monitored at the input-side and the output-side of the relay when a predetermined time elapses after the relay is turned off or on.

* * * * *